US006402368B1

(12) United States Patent
Grimm et al.

(10) Patent No.: US 6,402,368 B1
(45) Date of Patent: Jun. 11, 2002

(54) WATCH PROVIDED WITH A TOURBILLON

(75) Inventors: Maurice Grimm; André Beyner, both of Saint-Blaise (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/352,117

(22) Filed: Jul. 13, 1999

(30) Foreign Application Priority Data

Jul. 16, 1998 (EP) ..... 98113226

(51) Int. Cl.[7] ..... G04B 15/00
(52) U.S. Cl. ..... 368/127; 368/142
(58) Field of Search ..... 368/76, 77, 124–128, 368/139, 144, 220

(56) References Cited

U.S. PATENT DOCUMENTS 5,608,694 A * 3/1997 Grimm et al. ..... 368/127
5,838,641 A * 11/1998 Tohkoku et al. ..... 368/127

FOREIGN PATENT DOCUMENTS

| | | |
|---|---|---|
| CH | 33368 A | 8/1905 |
| CH | 34980 A | 11/1905 |
| CH | 30754/568 A | 11/1905 |
| CH | 256 590 | 3/1949 |

* cited by examiner

*Primary Examiner*—Bernard Roskoski
(74) *Attorney, Agent, or Firm*—Griffin & Szipl, P.C.

(57) ABSTRACT

The watch provided with a tourbillon includes a regulating device (2) engaging with an escapement (3) which itself engages with a gear train (4) meshing with a fixed wheel (5). The regulating device, the escapement and the gear train are mounted on a plate (6) fixed to a pipe (7) rotatably mounted in a support plate (8, 46), this pipe being situated at the center of the watch and driven in rotation by a spring driven device (9). Preferably, the pipe (7) surrounds a cannon pinion (11) carrying a minutes hand (12), this cannon wheel in turn surrounding a shaft (13) carrying an hours hand (14). The shaft (13) and the cannon pinion (11) are connected by a motion work (15) which is situated underneath the plate.

17 Claims, 7 Drawing Sheets

WATCH PROVIDED WITH A TOURBILLON

FIELD OF THE INVENTION

The present invention relates to a watch provided with a tourbillon including a regulating device engaging with an escapement which itself engages with a pinion meshing with a fixed wheel, the regulating device, the escapement and the pinion being mounted on a plate fixed to a pipe rotatably mounted in a support plate, this pipe being situated at the center of the watch and driven in rotation by a driving device.

BACKGROUND OF THE INVENTION

A tourbillon watch answering the generic description given above is described in Swiss Patent No. 33 368. This document describes a watch movement whose regulating device and escapement are carried by a plate rotatably mounted at the center of the movement. The plate is fixed to a central pipe which ends in a pinion driven by a barrel spring via a wheel and pinion set formed of one wheel and one pinion, so that the plate is driven continuously in rotation with the pipe which is used as its pivoting shaft.

The pipe is engaged on a shaft which carries the minutes hand, this shaft ending in a pinion meshing with a wheel which is friction-tight fitted on a cover of the barrel. A cannon pinion is driven onto the shaft and follows the pipe. The cannon pinion drives a cannon wheel which carries the hours hand via a motion work. Moreover, the motion work is covered by a dial. It is clear from the foregoing that the plate is not entirely visible through the crystal since a motion work, which is itself hidden by a dial, is mounted above it.

It will further be noted that the escapement pinion is situated above the plate, so that the fixed wheel with which it meshes is also above the plate. This fixed wheel is secured to a bridge carried by four narrow arms, this bridge being placed on the plate. Consequently, the plate is partly hidden from view, not only by the motion work and the dial, but also by the central bridge and the arms connecting it to the movement support plate.

In conclusion, the tourbillon mechanism described in the aforecited Patent barely allows the elements of which it is constituted to be seen, in fact only the balance which rotates on itself and about the dial is visible. Conversely, the present invention proposes a rotating plate which is entirely visible from its center to its periphery, thus allowing the whole of the tourbillon mechanism to be seen.

SUMMARY OF THE INVENTION

The invention is characterized in that the fixed wheel and the pinion meshing therewith are situated below the plate. This allows the space above the dial to be freed of any fixed elements and any supports intended to carry such elements.

In a preferred embodiment, the pipe carrying the plate surrounds a cannon pinion carrying a minutes hand, this cannon pinion itself surrounding a shaft carrying an hours hand, the shaft and the cannon pinion being connected to each other by a motion work situated below the plate.

In another embodiment which does not include a cannon pinion, a minutes hand or indicator is mounted on the plate, while the pipe surrounds a shaft carrying an hours hand, the shaft and the pipe being connected to each other by a motion work situated below the plate.

BRIEF DESCRIPTION OF THE DRAWINGS

The invention will be explained in detail hereinafter by two embodiments given by way of example, these embodiments being illustrated by the annexed drawings, in which.

DETAILED DESCRIPTION OF PREFERRED EMBODIMENTS

The tourbillon watch is shown here in two embodiments given by way of example. The first embodiment is shown in cross-section in FIG. 1. This is the preferred embodiment. The second embodiment is shown in cross-section in FIG. 7. A perspective view able to accommodate both embodiments is shown in FIG. 8.

Figure 1:
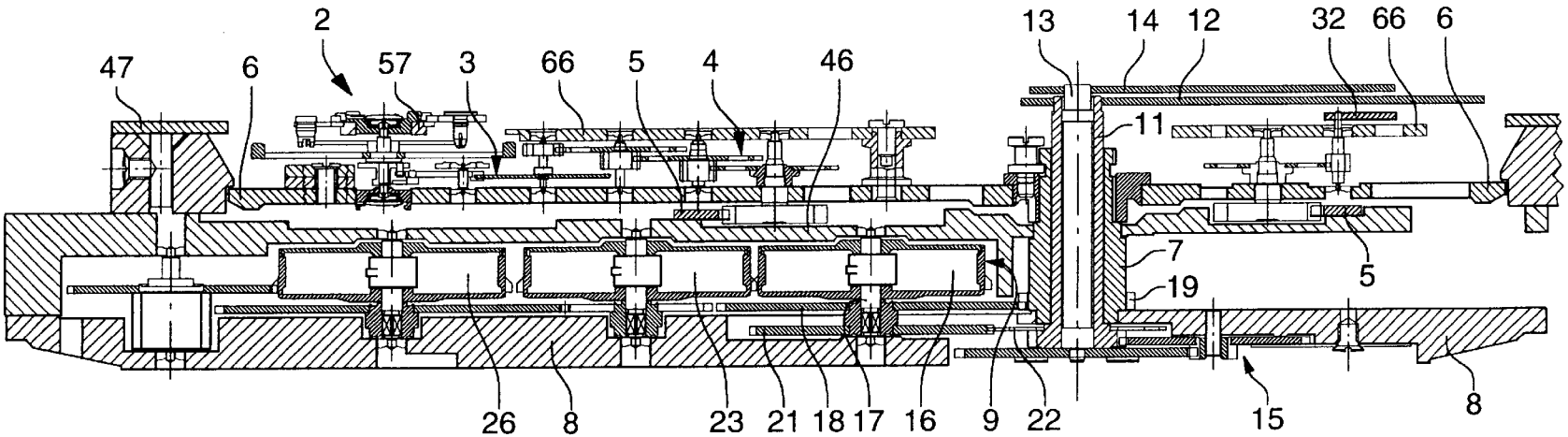
FIG. 1 is a schematic cross-section of a first embodiment of the invention.
Figure 7:
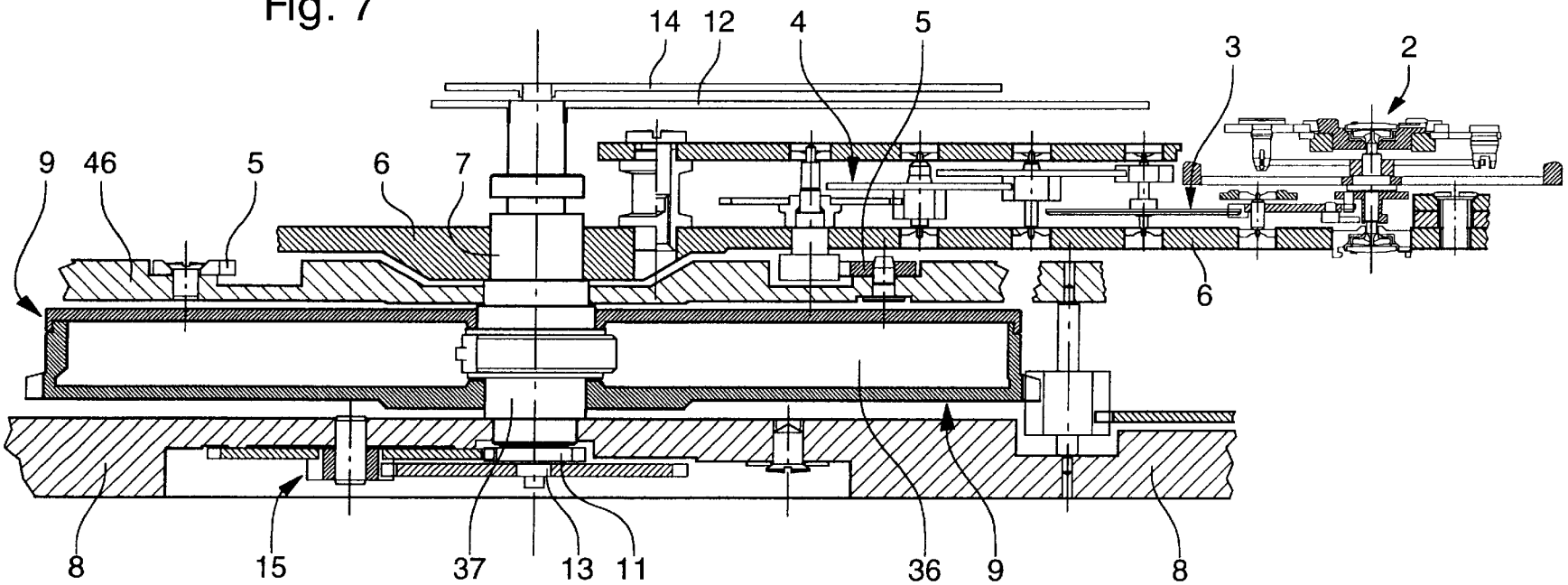
FIG. 7 is a schematic cross-section of a second embodiment of the invention.
Figure 8:
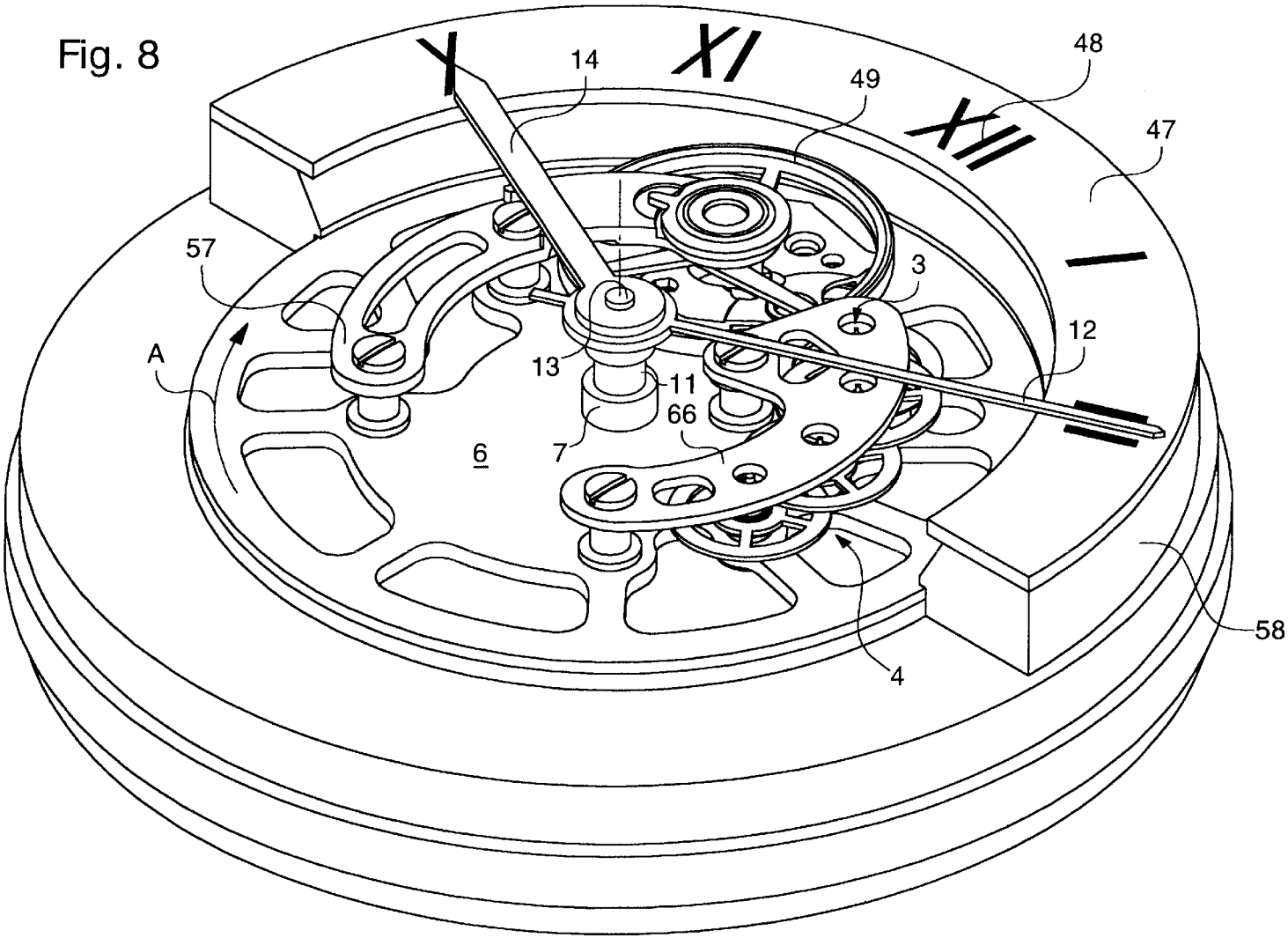
FIG. 8 is a perspective partially torn away view of the whole of the watch of the invention, shown without the case.

As is seen in FIGS. 1 and 7, the watch movement includes a regulating device 2 engaging with an escapement 3, the latter engaging with a gear train 4 meshing with a fixed wheel 5. Regulating device 2, escapement 3 and gear train 4 are mounted on a plate 6 fixed to a pipe 7 which is rotatably mounted in a support plate 8. Pipe 7 is situated at the center of the watch and is driven continuously in rotation by a driving device 9.

The originality of the watch lies in two particular features which enable the plate and the elements mounted thereon to be completely visible, from the center to the periphery thereof. FIGS. 1 and 7 show first that fixed wheel 5 is situated below plate 6. They then show that pipe 7 is engaged in a rotating manner on a cannon pinion 11 carrying a minutes hand 12, this cannon pinion being in turn engaged in a rotating manner on a shaft 13 carrying an hours hand 14. The lower ends of shaft 13 and cannon pinion 11 are connected by a motion work 15 situated lower than plate 6. Since fixed wheel 5 and motion work 15 are thus situated underneath plate 6, nothing is superposed with the plate which therefore remains entirely uncovered under the crystal which will be mounted thereabove. This is of course not the case of the construction proposed in the aforecited Patent Document, where a bridge-supporting the fixed wheel and the motion work is mounted above the plate.

It should be noted here that since shaft 13 carrying hours hand 14 is housed within cannon pinion 11 which carries minutes hand 12, hours hand 14 is located above minutes hand 12, which is the reverse of the ordinary situation usually found in timepieces, in which the cannon wheel carrying the hours hand surrounds the cannon pinion which carries the minutes hand. This anomaly in a way represents the price which has to be paid for placing the motion work under the plate, however this is a small price if one considers that it means only contravening a practice generally imposed by current design.

Figure 3:
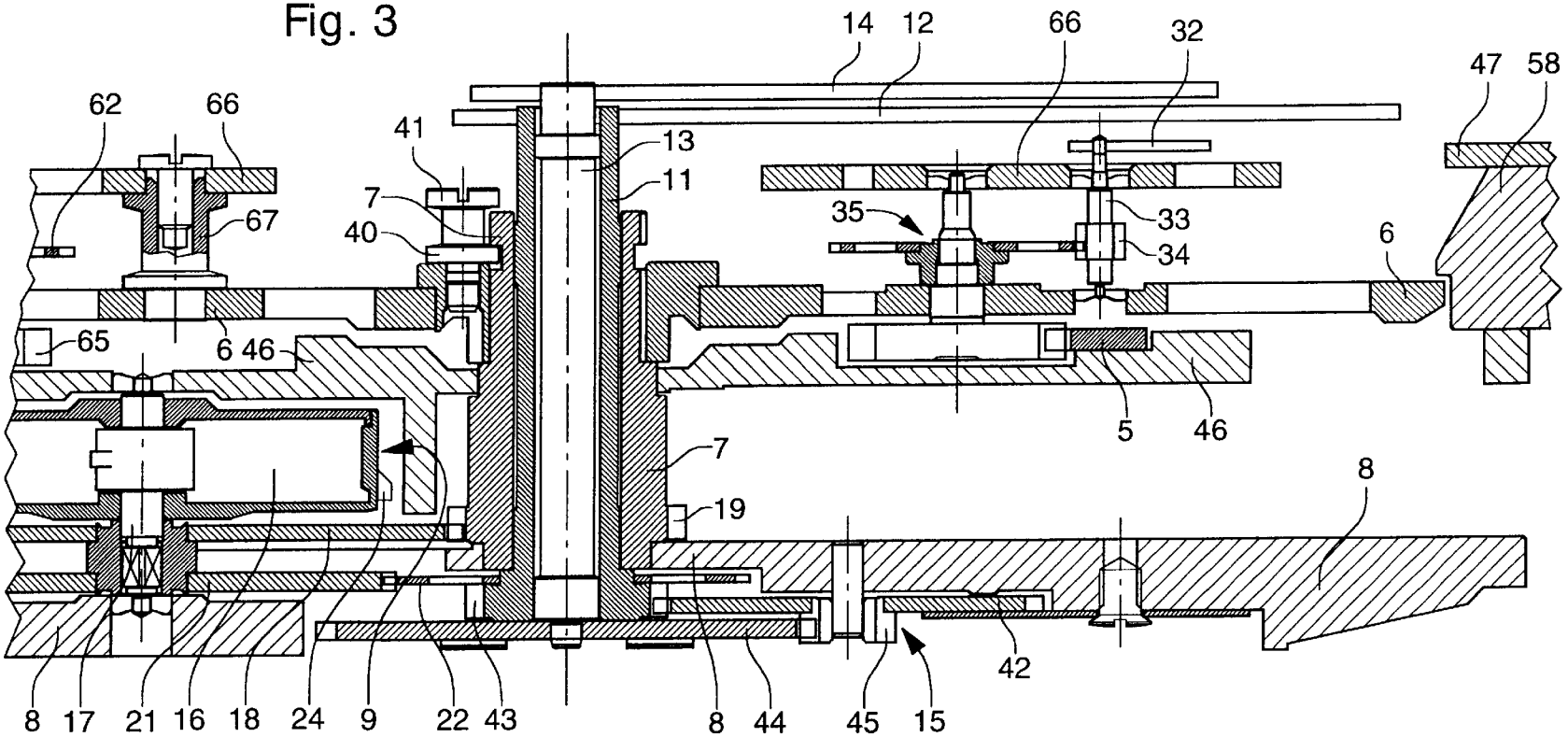
FIG. 3 is an enlargement of the right portion of the cross-section of FIG. 1.

FIGS. 1 and 3 show that driving device 9 includes a barrel 16 which contains a main spring (not shown) and whose shaft 17 carries a first ratchet 18. Ratchet 18 meshes with a pinion 19 which is secured to pipe 7 to which plate 6 is fixed.

Plate 6 can be fixed to pipe 7 in different ways. Here one has chosen to use a key 40 which is rotated by means of its screw head 41 to lock the plate onto the pipe.

The same Figures show that shaft 17 of the barrel carries a second ratchet 21 which is coaxial to first ratchet 18 and situated underneath the latter. Second ratchet 21 meshes with a wheel 22 which is friction-tight fitted on cannon pinion 11. Wheel 42 of motion work 15 is meshed with pinion 43 of cannon pinion 11. Likewise, hours wheel 44 of shaft 13 is meshed with pinion 45 of wheel 42 of motion work 15.

Figure 2:
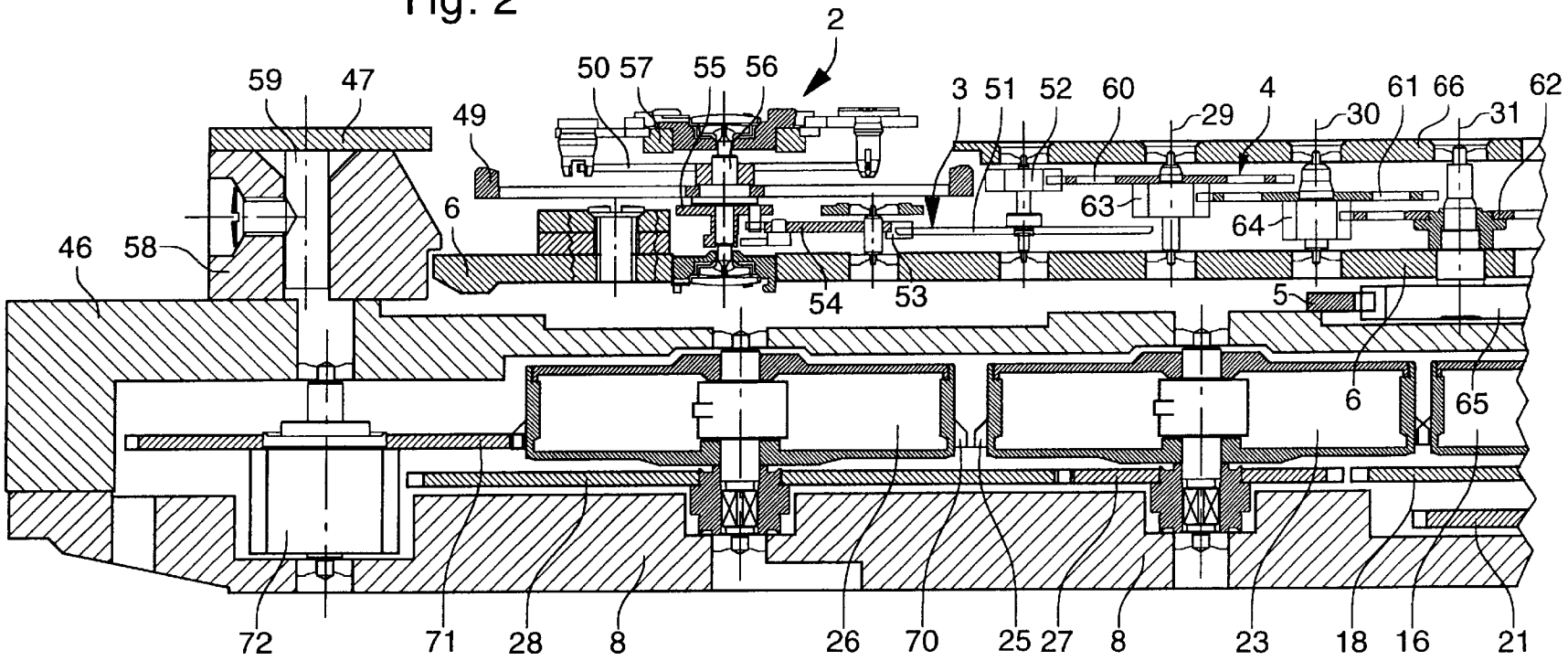
FIG. 2 is an enlargement of the left portion of the cross-section of FIG. 1.

If a single barrel is deemed insufficient to assure satisfactory autonomy for the mechanism, other barrels could be added to it which would allow the duration of run of the watch to be increased. This is the case shown in FIGS. 1 and 2, where first barrel 16 is preceded by a second spring barrel 23 meshed with the first by toothings 24 and 25 of their respective drums. Moreover, FIG. 2 shows that second barrel 23 is meshed with a third spring barrel 26 by the toothings of their respective ratchets 27 and 28. Driving device 9 thus includes three barrels in series.

It should be noted that the three barrels 16, 23 and 26 arranged in a same plane only occupy approximately three-quarters of the space available in this plane around central pipe 7. In the fourth quarter, it is possible to arrange an automatic winding mechanism engaging with driving device 9, in this case its third barrel 26.

A ring shaped dial 47 provided with markings 48 (see FIG. 8) surrounds plate 6. Ring 47 is held in a fixed ring 58 by means of dial feet 59.

It was indicated hereinbefore that pipe 7 carrying plate 6 is pivotably mounted in a support plate 8. In fact this support plate is fixed to a barrel bridge 46 in which pipe 7 is also pivotably mounted, so that the pipe is held in place radially and axially by pipe 8 and by barrel bridge 46 (see FIG. 3).

The two ratchets 18 and 21 fitted to barrel 16 can be of the same diameter or of different diameters. If they have the same diameter, it is clear that pinion 19 and wheel 22 will have the same diameter and that consequently cannon pinion 11 and minutes hand 12 which is connected thereto will rotate at the same speed as pipe 7 and plate 6 which is connected thereto, i.e. one revolution per hour. In the example shown in FIG. 3, the diameter of ratchet 18 is greater than the diameter of ratchet 21, as a result of which plate 6 will rotate more quickly than minutes hand 12.

In the event that one accepts that plate 6 rotates at the same speed as minutes hand 12, one could omit second ratchet 21 on condition that pipe 7 is friction-tight fitted onto cannon pinion 11. One would thus have a variant wherein a driving device including a barrel whose shaft carries a ratchet meshing with a pinion fixed to pipe 7, this pipe being friction-tight fitted onto cannon pinion 11. This variant has many similarities with the second embodiment which will be explained hereinafter with reference to FIG. 7.

This variant can also be modified in the following manner. Since in this case the plate makes one revolution per hour, it can itself carry the minutes indicator member, which allows cannon pinion 11 to be omitted. For example, a minutes hand or similar pointer can be mounted on plate 6 facing annular dial 47, in a fixed position with respect to the location of regulator 2 and gear train 4, so as to offer an attractive appearance, and arrange a friction coupling between the plate and its shaft in order to allow timesetting via action on the periphery of the plate. Otherwise, a minutes index can be provided on a ring friction-tight fitted on the periphery of plate 6 and engaging with a pinion of the winding stem for timesetting.

Plate 6 and the elements which are mounted thereabove in the construction illustrated by FIGS. 1 to 6 and 8 will now be examined in more detail. In this case, plate 6 is fixed to pipe 7 through which cannon pinion 11 and shaft 13 respectively carrying minutes hand 12 and hours hand 14 pass.

As is seen clearly in FIG. 2, regulating device 2, escapement 3 and gear train 4 are on plate 6. The tourbillon described in Swiss Patent No. 33368 includes the same elements except gear train 4, since the escapement pinion then meshes directly with the fixed wheel.

Regulating device 2 includes in the usual manner a balance 49 and a spiral spring 50. The escapement includes the escapement wheel 51 and its pinion 52, pallets 53, lever 54, the large plate 55 and the balance shaft 56. The balance shaft is pivotably mounted between plate 6 and a balance 57 fixed onto plate 6 by means of pillars 68 (see FIG. 4). Gear train 4 includes a plurality of wheel and pinion sets assuring a gear link between escapement pinion 52 and fixed wheel 5. There are three wheel and pinion sets here 29, 30 and 31 each including a wheel (respectively 60, 61 and 62) and a pinion (63, 64 and 65). These wheel and pinion sets are pivotably mounted between plate 6 and a gear train bridge 66. The gear train bridge is fixed onto plate 6 by means of pillars 67 (see FIG. 4).

The number of wheel and pinion sets (here wheel and pinion sets 29, 30 and 31) forming gear train 4 and the gear ratios existing between such wheel and pinion sets will depend upon the frequency of the balance and the number of revolutions per unit of time selected for the rotation of plate 6. This gear train is inserted between escapement 4 (more precisely escapement pinion 52) and fixed wheel 5. Its features and particularities thus impose on the plate a predetermined number of revolutions by unit of time.

An example of a preferred choice will be provided here. Balance 49 oscillates at a rate of 21,600 vibrations per hour. If escapement wheel 51 is provided with 20 teeth, this wheel and pinion 52 which is connected thereto will make 540 revolutions per hour. Gear train 4 includes the three wheel and pinion sets 29, 30 and 31 the gear ratio of which between escapement pinion 52 and the fixed wheel is 270. As a result, plate 6 makes two revolutions per hour. It is clear that other ratios could be selected to obtain other speeds of plate 6, which will be discussed hereinafter with reference to the second embodiment of the invention. It will however be noted here that the preferred speed of two revolutions per hour appears proper since it allows another image of the position of the plate to be obtained at least every five minutes.

One can take advantage of the presence of rotating plate 6 to fit the watch with a small seconds hand 32. For this purpose, FIG. 3 shows that plate 6 carries a wheel and pinion set 35 which meshes with fixed wheel 5, this wheel and pinion set driving in turn a pinion 34 fixed onto a shaft 33, on which small seconds hand 32 is driven. Shaft 33 and wheel and pinion set 35 are pivotably mounted between plate 6 and gear train bridge 66. As is seen in FIG. 4, seconds hand 32 is mounted on gear train bridge 66 onto which the second divisions 69 are marked.

Figure 4:
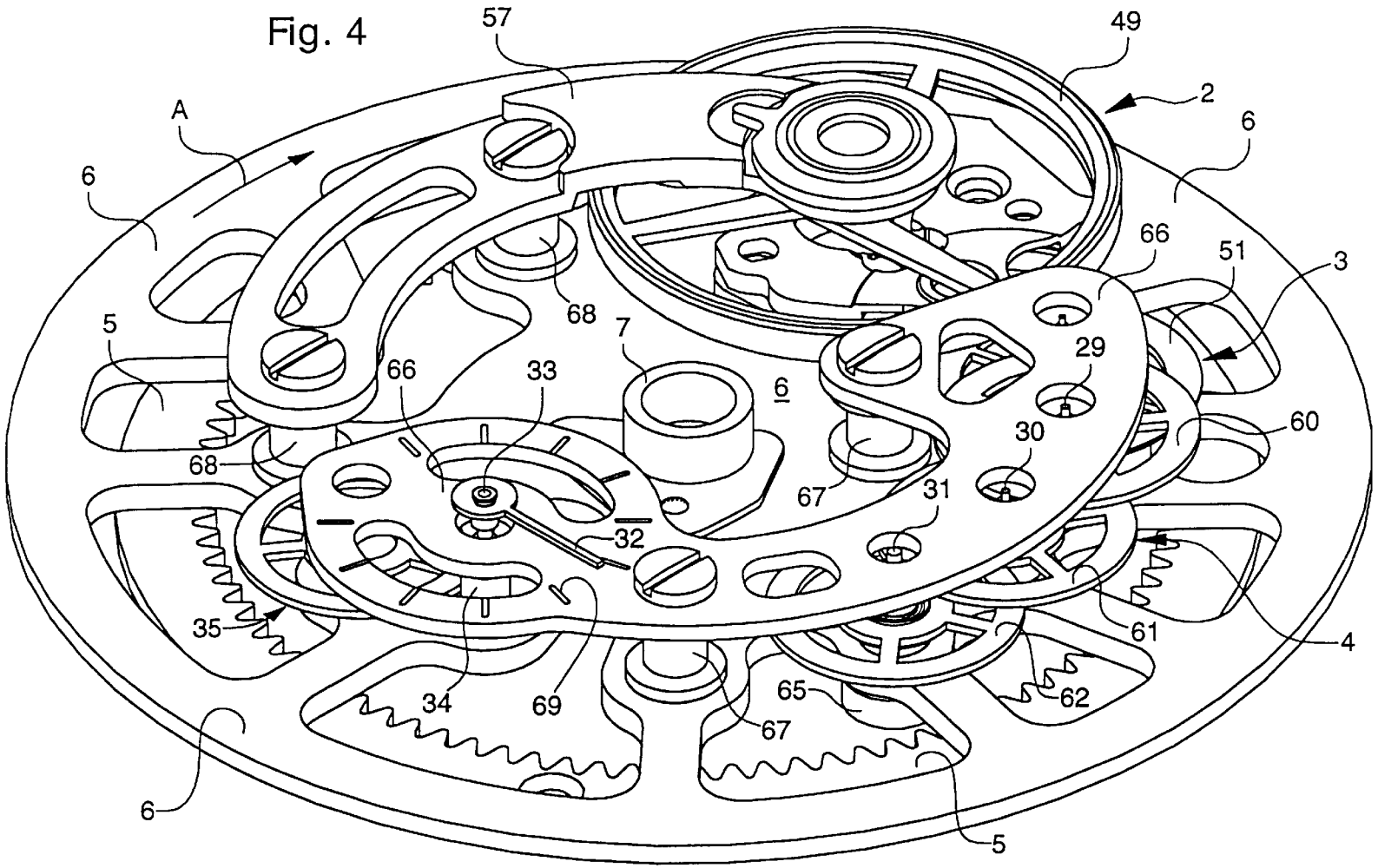
FIG. 4 is a perspective view of the tourbillon portion of FIG. 1.

FIG. 4 is a perspective view of rotating plate 6 forming the base of the tourbillon. Pipe 7 drives plate 6 in continuous rotation along the direction of arrow A. Below the plate, fixed wheel 5 is meshed with pinion 65. While rotating, plate 6 drives pinion 65 in a rotational movement combined with a movement of revolution in the manner of a satellite, these movements being regulated by gear train 4, escapement 3 and regulator 2. FIG. 4 shows very clearly the main advantage of the present invention, namely the total visibility of the whole of the plate and the elements mounted thereon. Everything is visible from pipe 7 to the periphery of plate 6 and no fixed part, like for example the fixed wheel or the motion work or even the dial, obstructs the view of the moving parts. Only the hours and minutes hands emerging from pipe 7 (not shown in FIG. 4) are mounted above the plate. However, since they are thin and essentially mobile, they do not hide anything.

FIG. 4 also shows that the plate can be arranged to have certain aesthetic effects. Here, for example, gear train bridge 66 which ends in second dial 69 and balance bridge 57 which ends in balance 49 recall somewhat the configuration of comets. And since these bridges are placed head-to-tail, the comets which they are supposed to represent each seem to follow each other.

Further explanations will be given by way of example as regards the winding and timesetting mechanisms of the watch.

Figure 5:
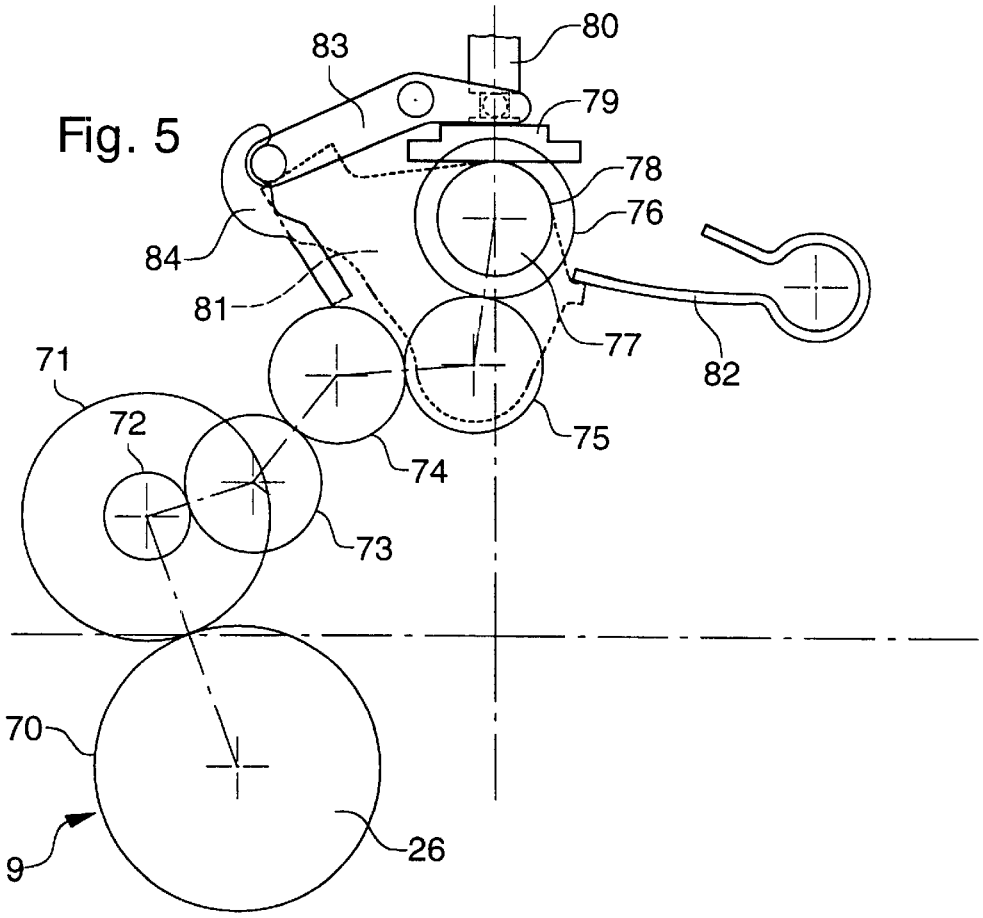
FIG. 5 is a plane view of the winding kinematics of the watch shown in FIG. 1.

The winding mechanism is shown in plane in FIG. 5. Driving device 9, in this case its third barrel 26 (FIG. 2), is meshed via toothing 70 of the barrel with a wheel 71 fixed to an intermediate pinion 72. This pinion engages with a first intermediate wheel 73 which in turn engages with a second intermediate wheel 74. When winding stem 80 is in a pushed in position, fixed intermediate wheel 74 engages with a intermediate wheel 75 of a rocking bar, which in turn engages with the horizontal toothing 76 of a 90° intermediate wheel carrying the reference 77. The vertical toothing 78 of the 90° intermediate wheel is meshed with a sliding pinion 79 of stem 80. A system formed of a rocking bar 81 on which a spring 82 acts and a pull-out piece 83, on which a two notch spring 84 acts, couples intermediate wheel 75 to second intermediate wheel 74. Barrel 26 is wound by rotation of stem 80 and it winds the following barrels 23 and 16.

Figure 6:
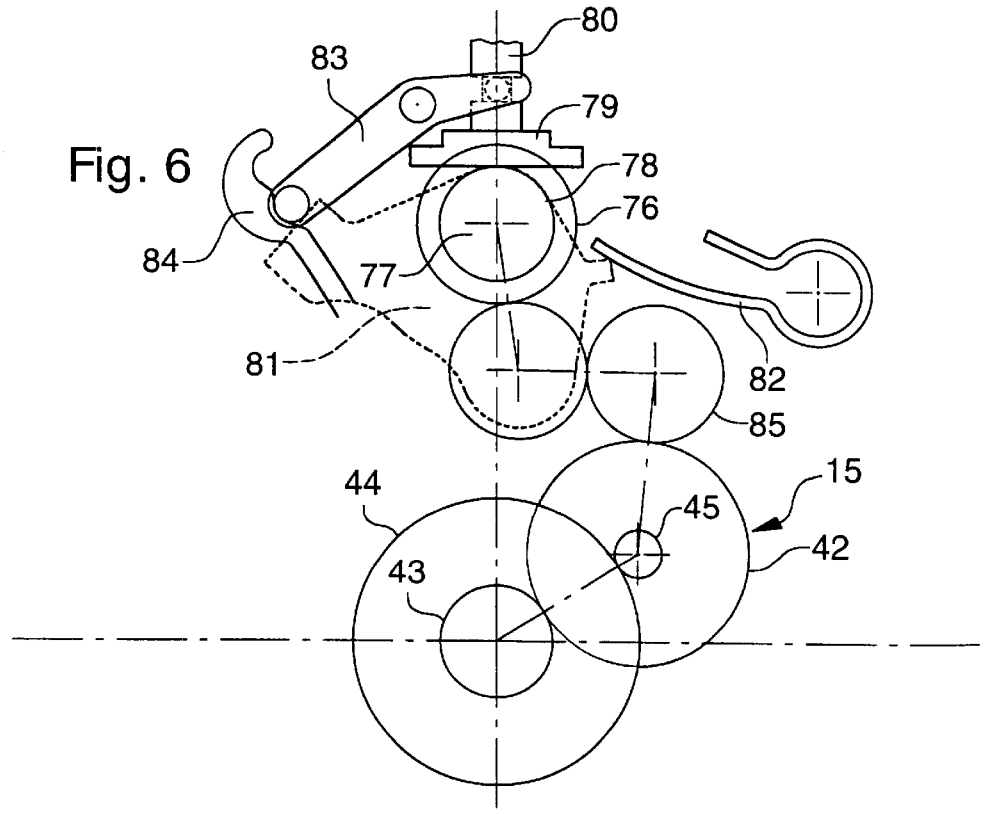
FIG. 6 is a plane view of the time setting kinematics of the watch shown in FIG. 1.

The timesetting mechanism is shown in plane in FIG. 6. When stem 80 is arranged in the pulled out position, rocking bar 81 rotates anti-clockwise about-its axis of rotation situated at the center of intermediate wheel 77. At this moment, intermediate wheel 77 is uncoupled from second intermediate wheel 74 (FIG. 5) and engages with a intermediate wheel 85. This intermediate wheel 85 is meshed with wheel 42 of motion work 15, this wheel 42 engaging with pinion 43 of cannon pinion 11 (see also FIG. 3). Likewise, hours wheel 44 is meshed with pinion 45 of motion work 15. In these conditions, when stem 80 is rotated, the minutes and hours hands are set. It will be noted here that timesetting does not involve any movement of pipe 7 and thus of plate 6, since there is friction between cannon pinion 11 and wheel 22 engaging with ratchet 21 (see FIG. 3).

The second embodiment of the invention will now be described with reference to FIG. 7. This second embodiment has numerous similarities with the first. A regulator device 2 meshed with an escapement 3 which is in turn meshed with a gear train 4 engaging with a fixed wheel 5 are again shown, regulator device 2, escapement 3 and gear train 4 being mounted on a plate 6. Plate 6 is fixed to a pipe 7 pivotably mounted in a support plate 8 and a barrel bridge 46, this pipe being situated at the center of the watch and driven continuously in rotation by a driving device 9. FIG. 7 also shows, on the one hand, that fixed wheel 5 is situated below plate 6 and, on the other hand, that pipe 7 is engaged in rotation on a cannon pinion 11 carrying a minutes hand 12, this cannon pinion being in turn engaged in rotation on a shaft 13 carrying an hours hand 14. Shaft 13 and cannon pinion 11 are connected by a motion work 15 situated below plate 6.

If the first embodiment includes a driving device 9 whose output member is the ratchet 18 of a barrel 16 off-center with respect to the center of the watch, the second embodiment includes a driving device 9 including a spring barrel 36 (see FIG. 7) situated at the center of the watch, shaft 37 of this barrel being connected in rotation to pipe 7 carrying plate 6 of the tourbillon. Preferably, shaft 37 itself constitutes pipe 7. In this second embodiment, one saves one ratchet and one pinion meshed therewith. Shaft 37 of barrel 36 is then friction-tight fitted onto cannon pinion 11, while hours shaft 13 is free to rotate in cannon pinion 11. This method necessarily involves a constraint: plate 6 is driven at the same speed as the minutes hand, i.e. one revolution per hour. According to the space available, one could choose either a single barrel of large diameter, or a second barrel placed in series with the central barrel. The aforementioned variants, wherein the plate makes one revolution per hour, are also applicable to this second embodiment.

In conclusion, FIG. 8 which is a partially torn away perspective view of the whole of the watch without its case, will be considered again. Plate 6 to which is fixed driving pipe 7, through which cannon pinion 11 and hours shaft 13 respectively pass, are again shown. Hours hand 14 and minutes hand 12 are mounted above annular dial 47. The dial shows inscriptions 48 and rests on ring 58 which can form part of the middle part of the watch. Plate 6 is driven in continuous rotation along the direction indicated by arrow A. Bridge 57 in which balance 49 is pivotably mounted and bridge 66 in which gear train 4 is pivotably mounted and escapement 3 rest on the plate. This Figure shows, even better than all the others, that plate 6 and all the elements which form part thereof are entirely visible from the exterior of the watch, this visibility being due to the fact that the motion work and the fixed wheel are relegated to underneath plate 6, as was explained hereinbefore. It will be noted that the product shown in FIG. 8 is a model without a small seconds hand.

What is claimed is:

1. A watch provided with a tourbillon including a regulating device engaging with an escapement which is operately connected to a pinion meshing with a fixed wheel, said regulating device, said escapement and said pinion being mounted on a plate fixed to a pipe rotatably mounted in a support plate, said regulating device and said escapement being situated above said plate, said pipe being situated at the center of the watch and driven in rotation by a driving device, wherein at least one hand shaft is rotatably mounted within said pipe, and wherein said fixed wheel and said pinion meshing therewith are situated underneath said plate.

2. A watch according to claim 1, wherein said pipe surrounds two of said hand shafts, said hand shafts comprising a cannon-pinion carrying a minutes hand, said cannon-pinion itself surrounding an hours shaft carrying an hours hand, said shaft and said cannon-pinion being connected to each other by a motion work situated underneath said plate.

3. A watch according to claim 1, wherein said driving device includes a spring barrel whose shaft carries a first ratchet engaging with a pinion fixed to said pipe.

4. A watch according to claim 2, wherein said driving device includes a spring barrel whose shaft carries a first ratchet engaging with a pinion fixed to said pipe and wherein said shaft of said spring barrel carries a second ratchet which is coaxial to the first and situated under the latter, said second ratchet engaging with a wheel friction-tight fitted onto the cannon-pinion.

5. A watch according to claim 2, wherein said driving device includes a spring barrel whose shaft carries a first ratchet engaging with a pinion fixed to said pipe and wherein said pipe is friction-tight fitted onto said cannon-pinion.

6. A watch according to claim 3, wherein said spring barrel is preceded by a second spring barrel meshed with said spring barrel by toothings of their respective drums, and by a third spring barrel meshed with said second spring barrel by toothings of their respective ratchets.

7. A watch according to claim 1, wherein a gear train is inserted between said escapement and said pinion meshing with said fixed wheel, said gear train including a plurality of wheel and pinion sets engaging one after the other, the number of said wheel and pinion sets and their gear ratios being selected so as to cause said plate to rotate according to a determined number of revolutions per unit of time.

8. A watch according to claim 7, wherein the gear train includes three wheel and pinion sets whose gear ratios are arranged so as to cause said plate to rotate at a rate of two revolutions per hour.

9. A watch according to claim 3, wherein a minutes hand or index is mounted on said plate, which makes one revolution per hour, and wherein said hand shaft surrounded by said pipe carries an hours hand, said hand shaft and said pipe being connected to each other by a motion work situated underneath the plate.

10. A watch according to claim 1, wherein a small seconds hand fixed to a pinion meshed with a wheel and pinion set engaged with said fixed wheel is mounted on said plate.

11. A watch according to claim 1, wherein said driving device includes a central spring barrel situated at the center of the watch, a shaft of said spring-barrel being connected to said pipe carrying said plate.

12. A watch according to claim 11, wherein said pipe is formed by said shaft of said central spring barrel.

13. A watch according to claim 11, wherein said pipe surrounds two of said hand shafts, said hand shafts comprising a cannon-pinion carrying a minutes hand, said cannon-pinion itself surrounding an hours shaft carrying an hours hand, said hours hand and said cannon-pinion being connected to each other by a motion work situated underneath said central spring barrel.

14. A watch according to claim 13, wherein said spring barrel shaft is friction-tight fitted onto said cannon-pinion.

15. A watch according to claim 2, wherein said motion work comprises an hours wheel fixed to said hours shaft and a wheel and pinion set meshing with said cannon-pinion and said hours wheel.

16. A watch provided with a tourbillon including a regulating device engaging with an escapement which is operately connected to a pinion meshing with a fixed wheel, said regulating device, said escapement and said pinion being mounted on a plate fixed to a pipe rotatably mounted in a support plate, said regulating device and said escapement being situated above said plate, said pipe being situated at the center of the watch and driven in rotation by a driving device, wherein said pipe surrounds a cannon-pinion carrying a minutes hand, said cannon-pinion itself surrounding an hours shaft carrying an hours hand, said hours shaft and said cannon-pinion being connected to each other by a motion work situated underneath said plate.

17. A watch provided with a tourbillon including a regulating device engaging with an escapement which is operately connected to a pinion meshing with a fixed wheel, said regulating device, said escapement and said pinion being mounted on a plate fixed to a pipe rotatably mounted in a support plate, said regulating device and said escapement being situated above said plate, said pipe being situated at the center of the watch and driven in rotation by a driving device, wherein at least one hand shaft is rotatably mounted within said tube, and wherein a gear train is inserted between said escapement and said pinion meshing with said fixed wheel, said gear train including a plurality of wheel and pinion sets engaging one after the other.

* * * * *